United States Patent [19]

Waldman

[11] 3,943,485

[45] Mar. 9, 1976

[54] ALARM SYSTEM FOR THREE-ELEMENT WINDOWS

[75] Inventor: Martin Waldman, Titusville, N.J.

[73] Assignee: Marjo Systems, Inc., Rahway, N.J.

[22] Filed: May 1, 1975

[21] Appl. No.: 573,740

[52] U.S. Cl. ..... 340/274 R; 200/61.93; 335/206; 335/207

[51] Int. Cl.[2] ..... G08B 13/08

[58] Field of Search ..... 340/274 R; 335/206, 207; 200/61.69, 61.84, 61.93

[56] References Cited

UNITED STATES PATENTS 3,710,369 1/1973 Takahashi ..... 340/274

3,742,479 6/1973 Williams ..... 200/61.93

*Primary Examiner*—Glen R. Swann, III

*Attorney, Agent, or Firm*—Lerner, David, Littenberg & Samuel

[57] ABSTRACT

An alarm system is constructed to energize when the bottom window or the top window of a three-element window assembly is opened, so long as the third element (usually a screen) is not in its closed position in front of the window being opened or if the third element is removed from its mounting slides.

The switching functions are performed by magnetic reed switches imbedded in the window frame and responsive to permanent magnets in the peripheral frame of the respective elements.

9 Claims, 4 Drawing Figures

ALARM SYSTEM FOR THREE-ELEMENT WINDOWS

FIELD OF THE INVENTION

This invention relates to alarm systems, such as burglar alarm systems, and more particularly relates to alarm systems which are particularly applicable to three-element window units which customarily include a lower window, an upper window, and a third element such as a screen.

BACKGROUND OF THE INVENTION

In recent years, there has been great emphasis placed on burglar alarm systems which set off an alarm in the event there is an unauthorized opening of doors and/or windows. In the area of window security, typical prior art installations include switching circuits which are "made" or "interrupted" in the event that the bottom window or top window of a two window installation is moved to an open position by an unauthorized person. Recent prior art systems of this type typified by U.S. Pat. Nos. 3,596,021 and 3,710,369, employ magnetically operated switches which are switched between an open and closed position in response to the movement of an associated permanent magnet carried by the slidably mounted window elements.

One of the major drawbacks of prevalent burglar alarm systems of this type is the requirement that the switchable element activated by the selective closing and opening of the window elements have to be individually installed on the window frame of each window unit which is to be protected.

Another difficulty inherent in prior art burglar alarm systems of this type is their inability to simply and inexpensively taken into account the employment of a third window element such as a screen and the desirability of the home owner opening either the lower or upper window sash when the storm window or screen is located in front of the sash being opened.

SUMMARY OF THE INVENTION

The instant invention is directed to an alarm system for use with windows having three units, such as a lower window, an upper window and a third element such as a screen, and which permits the user to open the lower or upper window without setting off the alarm so long as the third element (i.e., the screen) is properly closed in front of the window unit being opened. In accordance with the invention, if the third element, for example, the screen, is positioned in front of the lower window, both the screen and the lower window would have to be opened to set off the alarm, whereas lowering the upper window would also set off the alarm. In the event that the third element, i.e., the screen, was positioned in front of the upper window, both the screen and the upper window would have to be lowered to trip the alarm while, of course, the opening of the lower window would also trip the alarm.

As a particularly advantageous feature of the instant invention, the switching elements employed to establish the selected circuits hereof are comprised of magnetically operated switches, such as magnetic reed switches, which are influenced by magnets carried by their respective window elements. As will be explained in greater detail, particularly advantageous arrangements are employed to minimize the number of magnetic switches required to perform the desired functions.

As a further feature of the instant invention, the alarm system hereof finds particular applicability in metallic window constructions in which the window opening is defined by a hollow frame and the respective window elements are enclosed by hollow framing. In accordance with this aspect of the invention, the magnetic reed switches employed herein are housed within the hollow framing defining the opening of the window and the associated magnets are housed within the extrusion-like framing which encloses the window panes. In this manner, the burglar alarm apparatus is completely enclosed and hidden from the view of a prospective interloper. Moreover, the window units can be preassembled in the factory with the magnetic switches and magnets in place and the entire window units, prewired and ready for circuit installation, easily installed at the site of the window opening, thus eliminating the customizing problem prevelent in the prior art.

DETAILED DESCRIPTION

Figure 1:
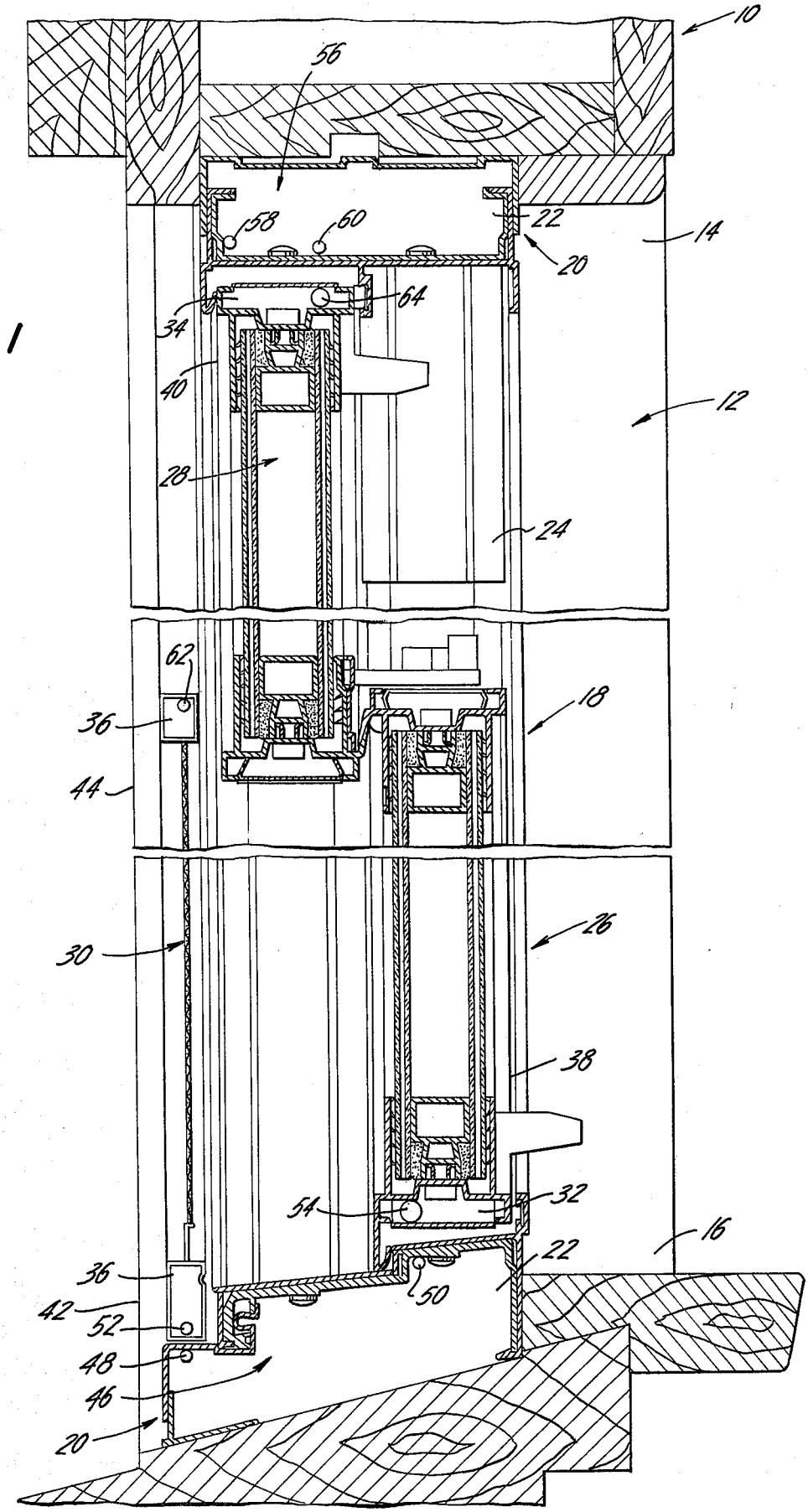
FIG. 1 is a side elevation, partly in section, of a window unit incorporating the alarm system of the present invention.

Turning to figures, wherein like numerals are used to designate like elements, there is shown in FIG. 1 a wall 10 having an opening 12 therethrough which for ease of definition may be said to have an upper end 14 and a lower end 16. Positioned within the opening 12 is a metallic window unit 18 incorporating an alarm system constructed in accordance with the instant invention. The window unit 18 includes a hollow frame 20 thereabout, the upper and lower portions thereof being designated by the numeral 22. The side portions 24 of the hollow frame 20 include, as is well known in the art, a plurality of tracks within which lower window unit 26, upper window unit 28, and a third unit 30 (screen) are slidably movable relative to one another and the opening. The three window elements 26, 28, and 20 are encased by hollow extrusion-like framing designated 32, 34 and 36, respectively.

As well understood, the lower window unit 26 is movable between a closed position in which a lower end 38 thereof is adjacent the lower end 16 of the opening and an open position in which the lower end 38 is away from the lower end 16 of the opening 12. Likewise, the upper window element 28 is movable between a closed position in which an upper end 40 thereof is adjacent the upper end 14 of the opening and an open position in which the upper end 40 of the window element 28 is away from the upper end of the opening. Likewise, the third element 30 (screen) is movable between a down-closed position (shown in FIG. 1) in which a lower end 42 thereof is adjacent the lower end 16 of the opening and an up-closed position (illustrated in FIG. 2) in which an upper end of the element 30 is adjacent the upper end 14 of the opening 12.

As well known, an alarm system should operate in the event that the lower element 26 or the upper element 28 move between their closed and opened position whenever the system has been energized. However, when employing a third slidable element such as a screen, it is frequently desirable to open the lower window element 26 when the third element, such as a screen, is positioned in front thereof. Likewise, when the third element, i.e., the screen 30, is positioned in front of the upper element 28, it is sometimes desirable to lower the upper element 28. in both situations, it is desirable that the alarm system not be set off. Of course, in dealing with the example illustrated in FIG. 1, should the window 26 be opened, and subsequently the screen element 30 opened, it is then desirable to trip the alarm system.

To accomplish all of the above functions, the alarm system of the instant invention includes first switching means broadly designated 46 (see also FIG. 3) switchable between first and second conditions in response to the first window element 26 being moved between its closed and opened position when the third element such as screen 30 is away from its said down-closed position. Additionally, the first switching means 46 will switch between its first and second conditions in response to the lower window element 26 being moved between its closed and opened position and the third element, such as the screen 30, being moved away from its down-closed position toward its up-closed position.

In the preferred embodiment, the first switching means 46 includes the electrically parallel arrangement of two normally open magnetic reed switches 48 and 50 which are maintained in their closed circuit position when associated permanent magnets 52 and 54 are in magnetic proximity thereto.

Figure 3:
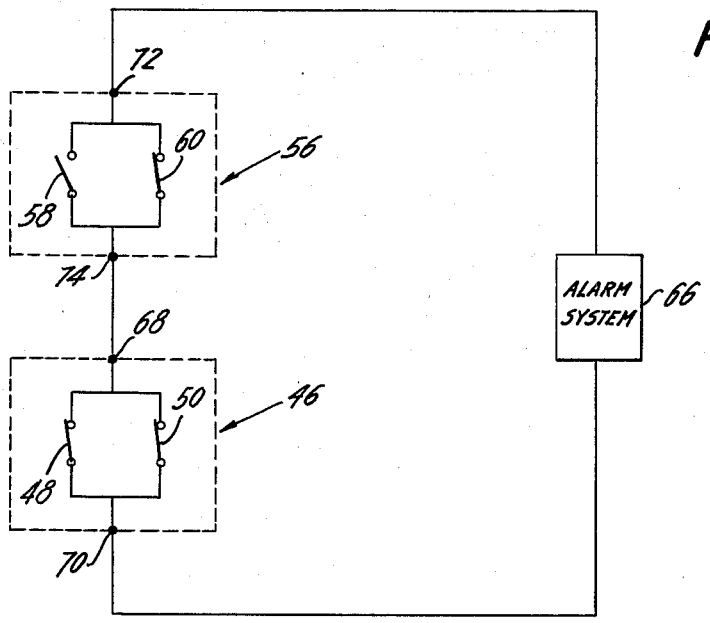
FIG. 3 is a schematic circuit diagram of the alarm system of the present invention.

The system further includes second switching means 56 switchable between first and second conditions in response to the second window element 28 being moved between its closed and opened position when the third element, such as the screen 30, is away from its said up-closed position (illustrated in FIG. 3). Alternatively, the second switching means 56 will switch between its first and second condition in response to the second window element 28 being moved between its closed and opened position and the third element, such as the screen 30, being moved from its up-closed position toward its down-closed position.

In the embodiment of FIG. 1, the second switching means comprises magnetic reed switches 58 and 60 which are normally open but maintained in their closed circuit position whenever influenced by their respective associated permanent magnets 62 and 64, respectively, carried by the screen element 30 and the upper window element 28, respectively.

The first and second switching systems 46 and 48 are connected in the manner shown in FIG. 3 with an alarm system broadly designated 66 which, by itself, forms no part of the instant invention and is of well-known construction.

The operation of the alarm system illustrated in connection with FIGS. 1 and 3 will now be explained. Assuming that the window elements are in the condition shown in FIG. 1, the first switching means 46 is in its closed circuit condition because the magnet 52 carried by the lower end of the screen 30 is maintaining the normally open reed switch 48 in its closed circuit condition, and the permanent magnet 54 carried at the lower end of the lower window 26 is maintaining the normally opened magnetic reed switch 50 in its closed circuit position. Thus, the first switching means 46 comprising the parallel network of the switches 48 and 50 maintains a closed circuit condition between its entry and exit points 68 and 70, respectively.

Turning to the second switching means 56, since the screen 30 in FIG. 1 is away from its up-closed position, the magnetic reed switch 58 reverts to its normally opened position shown in FIG. 3. However, since the upper window 28 is closed, the magnet 64 maintains the reed switch 60 in its closed circuit position illustrated in FIG. 3. Thus, with respect to its entry and exit points 72 and 74, respectively, second switching means 56 is still maintaining a closed circuit position (via the contact 60). So long as switching means 46 and 56 maintain this closed circuit condition, alarm 66 is not activated.

However, should an unauthorized person move the upper window 28 from its closed position toward its open position, reed switch 60 will revert to its normally opened position, thereby changing the condition of the second switching means 56 from closed circuit to open circuit (between points 72 and 74) and the alarm 66 will be energized.

Likewise, if an unauthorized person lifts the screen 30 and the lower window 26, reed switches 48 and 50 will open to change the status of first switching means 46 and interrupt the circuit between the points 68 and 70 to likewise trip the burglar alarm. However, should only the screen 30 be lifted or only the lower window 26 be opened, only one of the reed switches 48 and 50, respectively, would be opened and the first switching means 46 would maintain the closed circuit position between points 68 and 70.

Figure 2:
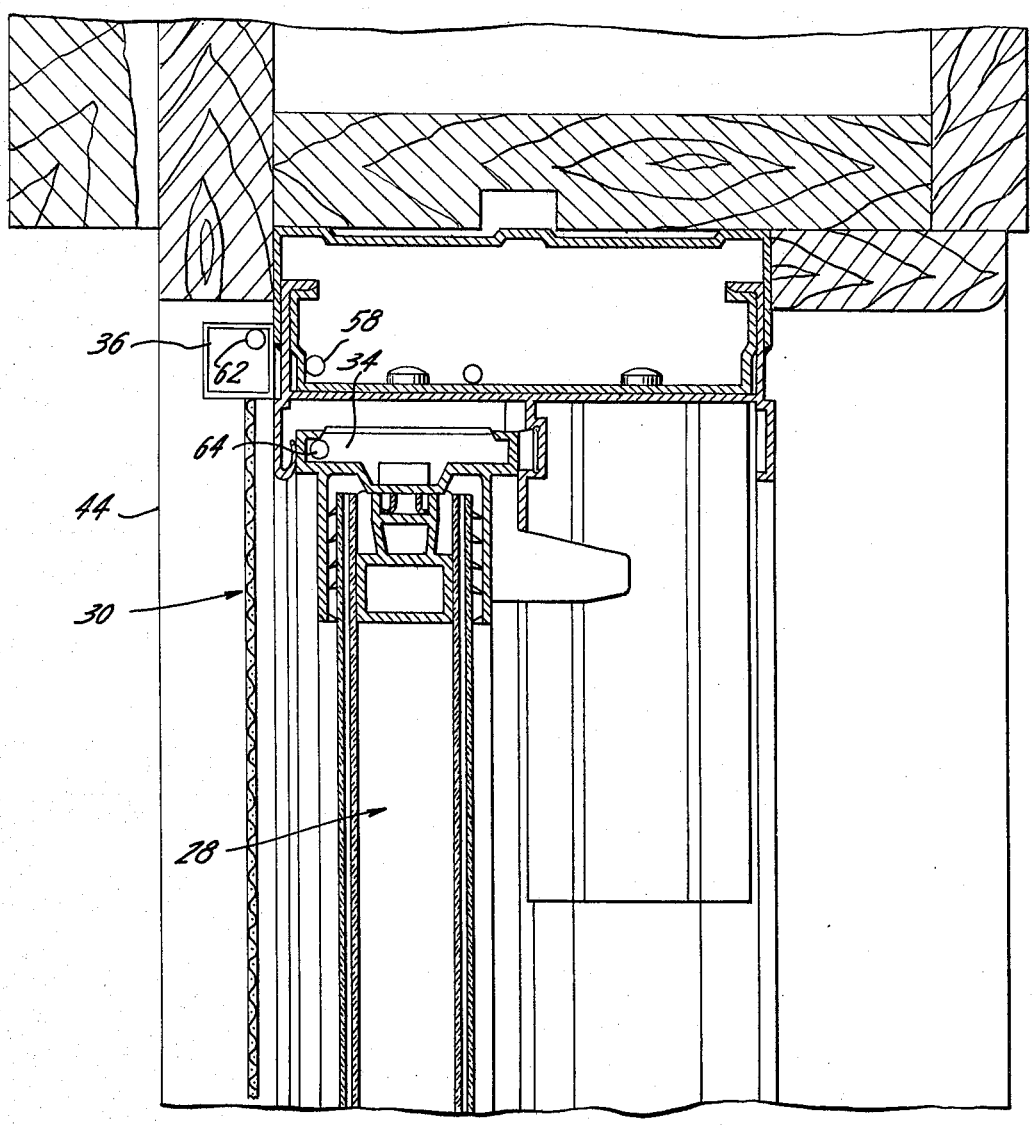
FIG. 2 is a side elevation, partly in section, of an alternative embodiment of the alarm system of the present invention.

The same advantageous operation would occur if the screen 30 were in the up-closed position illustrated in FIG. 2. In such an example, magnetic reed switches 58 and 60 would normally be closed and both the screen 30 and the upper element 28 would have to be lowered to trip the alarm system. Additionally, in such environment, the reed switch 48 would be opened, but the reed switch 50 would maintain the first switching means in a closed circuit condition between points 68 and 70 until such time as an unauthorized person where to open the lower window.

Thus, it can be seen that in accordance with this aspect of the instant invention, either window may be opened without setting off the alarm in the event that the third window element, such as the screen 30, is properly in front of it.

Figure 4:
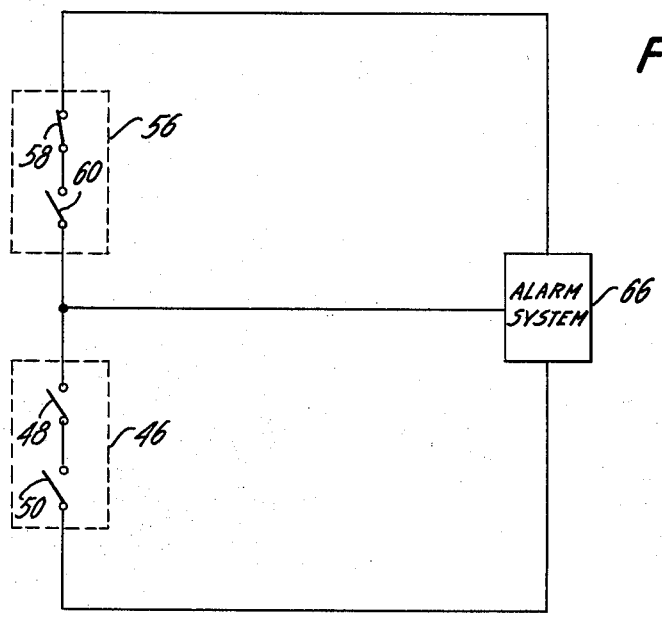
FIG. 4 is a schematic circuit diagram of an alternative embodiment of the alarm system of the instant invention.

This aspect of the instant invention may also be practiced using normally closed magnetic reed switches and the series circuits illustrated in FIG. 4. Thus, assuming the condition illustrated in FIG. 1, reed switch 58 is normally closed (not influenced by magnet 62) and any attempt to lower the upper window 28 will permit reed switch 60 to revert to its normally closed position and complete the series circuit to the alarm system 66. With respect to the first switching means 46, an unauthorized person would have to lift both the screen 30 and the lower window 26 to allow the reed switches 48 and 50 to revert to their normally closed condition and complete another series circuit with the alarm 66 for energization of same.

Referring to FIG. 2, a particularly advantageous embodiment of the invention is shown in which the magnet 64 carried within the extrusion framing 34 of the upper window 28 is moved to the left side thereof so that it may influence the magnetic reed switch 58. Thus, reed switch 58 is influenced by both the magnet 64 carried by the upper window 28 and influenced by the magnet 62 carried within the framing 36 provided around the screen element 30, thereby eliminating the need for switch 60.

Although simpler and less expensive, the arrangement of FIG. 2 is, circuitwise, the equivalent of the circuit shown in FIG. 3. That is to say, if only the upper window 28 or the screen 30 is lowered, the remaining element will maintain the reed switch 58 in the closed condition (or opened condition if FIG. 4 is being employed). If both the upper window and the screen are lowered, switch 58 will change over and initiate an alarm.

It should be noted that the arrangement shown in FIG. 2 is made possible because of the fact that magnets 62 and 64 are both sufficiently close to reed switch 58 to magnetically effect same. A similar arrangement could be provided at the lower end of the window if the magnets 52 and 54 are properly chosen with respect to a central location for the reed switch 48 so that both would magnetically influence same.

As noted at the outset, the invention has particular applicability to metallic window units which typically include a hollow extrusion frame such as 18 and the extrusion type framing 32, 34 and 36 which encase the respective window elements. With such a construction, the magnets and magnetic reed switches may be installed within the respective extrusions so as to be completely invisible to a prospective burglar. Also, such window units can be completely preassembled with an alarm system as an internal portion thereof and easily installed in an existing structure without the necessity of customizing each window opening for any portion of the burglar alarm system.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. An alarm system comprising:

first, second and third elements slidably positioned within an opening having upper and lower ends;

said first element being movable between a closed position in which a lower end of said first element is adjacent said lower end of said opening and an open position in which said lower end of said first element is away from said lower end of said opening;

said second element being movable between a closed position in which an upper end of said second element is adjacent said upper end of said opening and an open position in which said upper end of said second element is away from said upper end of said opening;

said third element being movable between a down-closed position in which a lower end of said third element is adjacent said lower end of said opening and an up-closed position in which an upper end of said third element is adjacent said upper end of said opening;

first switching means switchable between first and second conditions in response to said first element being moved between its closed and open position when said third element is away from its said down-closed position or in response to said first element being moved between its closed and open position and said third element being moved from its down-closed position towards its up-closed position;

second switching means switchable between first and second conditions in response to said second element being moved between its closed and open position when said third element is away from its said up-closed position or in response to said second element being moved between its closed and open position and said third element being moved from its up-closed position towards its down-closed position;

alarm means; and circuit means connecting said first and second switching means to said alarm means for energization of same in response to said first or second switching means switching between its first and second conditions.

2. The alarm system of claim 1 and further including a hollow frame positioned within said opening and within which said first, second and third elements are slidably mounted.

3. The alarm system of claim 2 wherein said first switching means comprises first and second switches responsive to a magnetic field positioned within said hollow frame adjacent said lower end of said opening and in magnetic proximity to the lower ends of said first and third elements respectively when said first and third elements are in their closed and down-closed position, respectively; and said first and third elements carry magnets adjacent their lower ends thereof.

4. The alarm system of claim 3 wherein said second switching means comprises first and second switches responsive to a magnetic field positioned within said hollow frame adjacent said upper end of said opening and in magnetic proximity to the upper ends of said second and third element respectively when said second and third elements are in their closed and up-closed position respectively; and said second and third elements carry magnets adjacent the upper ends thereof.

5. The alarm system of claim 3 wherein said second switching means comprises a switch responsive to a magnetic field positioned within said hollow frame adjacent said upper end of said opening and in magnetic proximity to the upper ends of said second and third elements when said second and third elements are in their closed and up-closed position respectively; and said second and third elements carry magnets adjacent the upper ends thereof.

6. The alarm system of claim 4 wherein said first, second and third elements are enclosed by hollow framing; and said magnets carried by said first, second and third elements are enclosed in said hollow framing.

7. The alarm system of claim 5 wherein said first, second and third elements are enclosed by hollow framing; and said magnets carried by said first, second and third elements are enclosed in said hollow framing.

8. The alarm system of claim 4 wherein said switches comprising said first and second switching means comprise normally open switches maintained in their closed condition when influenced by the field developed by their associated magnets.

9. The alarm system of claim 5 wherein said switches comprising said first and second switching means comprise normally open switches maintained in their closed condition when influenced by the field developed by their associated magnets.

* * * * *